United States Patent [19]

Silverberg

[11] Patent Number: 4,723,144

[45] Date of Patent: Feb. 2, 1988

[54] DEVELOPING OR CLEANING UNIT FOR AN ELECTROPHOTOGRAPHIC PRINTING MACHINE

[75] Inventor: Morton Silverberg, Rochester, N.Y.

[73] Assignee: Xerox Corporation, Stamford, Conn.

[21] Appl. No.: 470,362

[22] Filed: Feb. 28, 1983

[51] Int. Cl.[4] ..... G03G 15/09; G03G 21/00

[52] U.S. Cl. ..... 355/3 DD; 355/15; 118/652; 118/657

[58] Field of Search ..... 355/15, 16, 3 DD; 118/652, 657, 658, 656; 430/125, 122

[56] References Cited

U.S. PATENT DOCUMENTS

| | | | |
|---|---|---|---|
| 3,615,813 | 10/1971 | Clarke et al. | 355/15 Y |
| 3,838,921 | 10/1974 | Sargis | 355/15 |
| 4,264,182 | 4/1981 | Mitchell | 355/16 X |
| 4,320,958 | 4/1982 | Fantuzzo | 355/15 Y |
| 4,372,669 | 2/1983 | Fantuzzo et al. | 355/3 R |
| 4,397,264 | 8/1983 | Hatch | 118/657 Y |
| 4,398,496 | 8/1983 | Kopko | 355/3 DD Y |
| 4,499,851 | 2/1985 | Kopko et al. | 118/602 X |

OTHER PUBLICATIONS

*Xerox Disclosure Journal*, vol. 7, No. 3, May/Jun. 1982, Seanor, D. A., "Developer/Cleaner for Magnetic Tone with Enhanced Performance".

*Primary Examiner*—Arthur T. Grimley
*Assistant Examiner*—J. Pendegrass
*Attorney, Agent, or Firm*—H. Fleischer; J. E. Beck; R. Zibelli

[57] ABSTRACT

A processing station for use in electrophotographic printing machines to clean the photoconductive belt or develop the electrostatic latent image recorded thereon. A roller transports single component magnetic particles into contact with the photoconductive belt. The belt is deflected around the exterior circumferential surface of the roller to form an extended cleaning or development zone.

7 Claims, 6 Drawing Figures

DEVELOPING OR CLEANING UNIT FOR AN ELECTROPHOTOGRAPHIC PRINTING MACHINE

This invention relates generally to an electrophotographic printing machine, and more particularly concerns an improved processing station for cleaning the photoconductive surface or developing a latent image recorded thereon.

In an electrophotographic printing process, a photoconductive member has a surface thereof charged to a substantially uniform level. The charged photoconductive surface is exposed to a light image of an original document being reproduced. Exposure of the sensitized photoconductive surface selectively discharges the charge thereon. This records an electrostatic latent image on the photoconductive surface corresponding to the informational areas contained within the original document being reproduced. Development of the electrostatic latent image recorded on the photoconductive surface is achieved by bringing a developer material into contact therewith. This forms a powder image on the photoconductive member which is subsequently transferred to a copy sheet. Finally, the copy sheet is heated to permanently affix the powder image thereto in image configuration.

Hereinbefore, the steps of development and cleaning were generally performed at individual processing stations. Various types of devices have been devised to combine these steps into a single processing station. For example, U.S. Pat. No. 3,637,306, issued to Cooper on Jan. 25, 1972; U.S. Pat. No. 3,647,293, issued to Queener on Mar. 7, 1972; U.S. Pat. No. 3,838,921, issued to Sargis on Oct. 1, 1974 and U.S. Pat. No. 4,087,170, issued to Sawaoka et al. on May 2, 1978, all disclose magnetic brush units which serve both as the developing unit and the cleaning unit in the electrophotographic printing machine.

Until recently, magnetic brush systems used for development or cleaning employed either single or two component developer material and were spaced from the photoconductive surface. With the increased use of flexible photoconductive belts and magnetic brush development systems, it has become more feasible to control the spacing therebetween. When the photoconductive belt is maintained at the proper tension, it becomes practical to closely space the belt from the roller with the material interposed therebetween deflecting the photoconductive belt so as to form an extended development and cleaning zone. However, a magnetic brush systems of this type was hereinbefore used only with a two component developer material. The low magnetic force on the single component particles were believed to be insufficient to transport the particles through the region of a tensioned photoconductive belt.

Various types of magnetic brush systems have been devised to improve development or cleaning with a two component material, i.e. toner particles and carrier granules. The following disclosures appear to be relevant:

U.S. Pat. No. 4,320,958
Patentee: Fantuzzo
Issued: Mar. 23, 1982
U.S. Pat. No. 4,397,264
Patantee: Hatch
issued: Aug. 9, 1983.
U.S. Pat. No. 4,499,851

Patantee: Kopko et al.
Issued: Feb. 19, 1985
Co-pending Application Ser. No. 180,791
Applicant: Seanor
Filed: Aug. 25, 1980

The pertinent portions of the foregoing disclosures may be briefly summarized as follows:

Fantuzzo discloses a magnetic brush unit using a two component developer material for both cleaning and developing. The magnet is indexed so as to produce a weak magnetic field during development and a strong magnetic field during cleaning in the nip.

Hatch describes a development system in which a developer roller transports a two component developer material into contact with the photoconductive belt. The developer material being transported into contact with the photoconductive belt spaces the belt from the developer roller. The belt wraps around the developer roller defining an extended development zone.

Kopko et al. describes an electrophotographic printing machine in which a two component developer material on a developer roller deforms a tensioned photoconductive belt so as to space the developer roller from the belt. The photoconductive belt wraps around a portion of the exterior circumferential surface of the developer roller defining an extended development zone.

Seanor discloses a magnetic brush cleaning unit in which the two component cleaning material deflects the photoconductive belt to define an extended cleaning zone. The photoconductive belt wraps around a portion of the exterior circumferential surface of the cleaning roller.

In accordance with one aspect of the present invention, there is provided an apparatus for cleaning material from a flexible member or depositing single component magnetic particles thereon. Means, positioned closely adjacent the flexible member defining a cleaning or depositing zone, transport the single component magnetic particles into the zone to clean material from the region of the flexible member in the zone during cleaning or to deposit the single component magnetic particles on the region of the flexible member in the zone. Means maintain the flexible member at a preselected tension of sufficient magnitude so that at least the single component magnetic particles on the transporting means deflects the flexible member to wrap the flexible member about an extended region of the exterior surface of the transporting means. This forms an extended cleaning or depositing zone between the transporting means and the flexible member.

Pursuant to another aspect of the present invention, there is provided a processing station for use in an electrophotographic printing machine developing an electrostatic latent image recorded on a flexible photoconductive member or cleaning material therefrom. Means, positioned closely adjacent to the flexible photoconductive member define a cleaning or developing zone, for transporting single component magnetic particles into the zone to clean material from the region of the flexible photoconductive member in the zone during cleaning or to deposit single component magnetic particles on the region of the flexible photoconductive member in the zone when developing the latent image. Means are provided for maintaining the flexible photoconductive member at a pre-selected tension of sufficient magnitude so that at least the single component magnetic material on the transporting means deflects the flexible photoconductive member to wrap the flexible photoconductive member about an extended region of the exterior surface of the transporting means. This forms an extended cleaning or developing zone between the transporting means and the flexible photoconductive member.

Other aspects of the present invention will become apparent as the following description proceeds and upon reference to the drawings, in which.

While the present invention will hereinafter be described with reference to a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
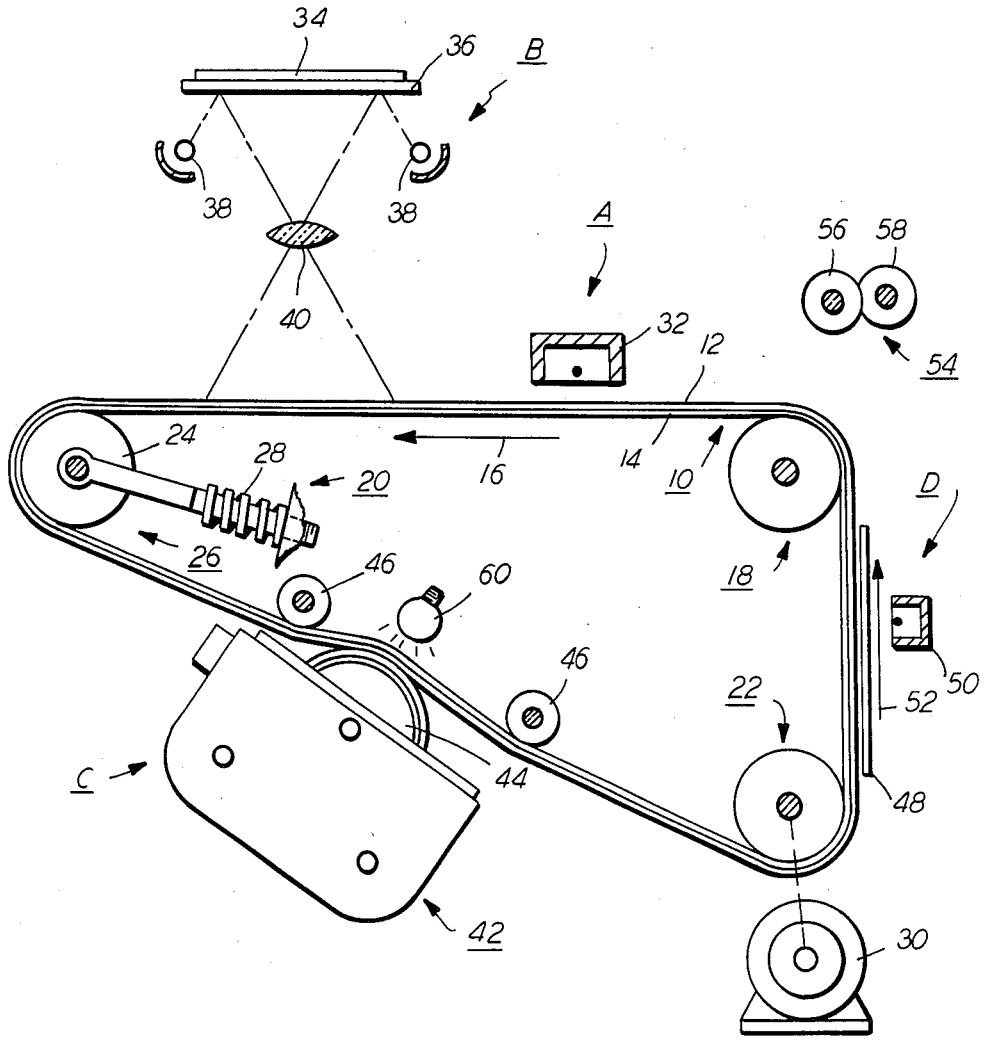
FIG. 1 is a schematic elevational view depicting an electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the processing station of the present invention therein. While the processing station has been described as being a combined cleaning and developing unit, it will become evident from the following discussion that it may be used only for cleaning or development. The combined cleaning and developing unit described hereinafter is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

In the illustrative electrophotographic printing machine, as shown in FIG. 1, a belt 10 having a photoconductive surface 12 deposited on a conductive substrate 14 moves in the direction of arrow 16. Preferably, the conductive substrate comprises a transparent support such as a poly (ethyleneterephathalate) cellulose acetate or other suitable photoconductive film support, typically having coated thereon a transparent conductive coating such as a high vacuum evaporated nickel, cuperous iodide, or any suitable conductive polymer. The conductive support is, in turn, overcoated with a photoconductive layer typically comprising a binder and an organic photoconductor. A wide variety of organic photoconductors may be employed in this invention. For example, an organic amine photoconductor or a polarylakane photoconductor may be used. However, one skilled in the art will appreciate that any type of organic photoconductor suitable for use with a transparent conductive substrate may be employed in the present invention. Various types of photoconductors are described in U.S. Pat. No. 3,734,724 issued to York in 1973, the relevant portions thereof being hereby incorporated into the present application. In the exemplary electrophotographic printing machine, the photoconductive layer has an electrostatic charge of a negative polarity recorded thereon with the charge on the toner particles being of a positive polarity.

With continued reference to FIG. 1, belt 10 moves in the direction of arrow 16 to advance successive portions of photoconductive surface 12 through the various processing stations disposed about the path of movement thereof. As shown, belt 10 is entrained about stripping roller 18, tensioning system 20 and drive roller 22. Tensioning system 20 includes a roller 24 over which belt 10 moves. Roller 24 is mounted rotatably in yoke 26. Spring 28, which is initially compressed, resiliently urges yoke 26 in a direction such that roller 24 presses against belt 10. The level of tension is relatively low permitting belt 10 to be easily deflected. The detailed structure of the tensioning system will be described hereinafter with reference to FIG. 2.

Drive roller 22 is mounted rotatably and in engagement with belt 10. Motor 30 rotates roller 22 to advance belt 10 in the direction of arrow 16. Roller 22 is coupled to motor 30 by suitable means such as a belt drive. Stripping roller 18 is freely rotatable so as to permit belt 10 to move in the direction of arrow 16 with a minimum of friction.

Initially, a portion of belt 10 passes through charging station A. At charging station A, a corona generating device, indicated generally by the reference numeral 32, charges the photoconductive surface of belt 10 to a relatively high, substantially uniform potential.

Next, the charged portion of the photoconductive surface is advanced through exposure station B. At exposure station B, an original document 34 is positioned facedown upon transparent platen 36. Lamps 38 flash light rays onto original document 34. The light rays reflected from original document 34 are transmitted through lens 40 forming a light image thereof. Lens 40 focuses the light image onto the charge portion of the photoconductive surface to selectively dissipate the charge thereon. This records an electrostatic latent image on the photoconductive surface which corresponds to the informational areas contained within original document 34.

Thereafter, belt 10 advances the electrostatic latent image recorded on the photoconductive surface to the combined developmentcleaning station C. At combined station C, a magnetic brush system, indicated generally by the reference numeral 42, transports a single component developer material of magnetic toner particles into contact with the photoconductive surface of belt 10 during the developing cycle. The toner particles are attracted to the electrostatic latent image forming a toner powder image corresponding to the informational areas of the original document. Magnetic brush unit 42 includes a roller 44. Roller 44 has a layer of magnetic toner particles attracted to the exterior circumferential surface thereof. During the development cycle, the toner particles are attracted from roller 44 to the electrostatic latent image recorded on the photoconductive surface forming a toner powder image thereon. As shown in FIG. 1, roller 44 is positioned such that at least the toner particles deform belt 10 between idler rollers 46 in an arc with belt 10 wrapping around at least a portion of the exterior circumferential surface of roller 44. The tangential velocity of roller 44, in the development zone, is in the same direction as the velocity of belt 10 with the magnitude thereof being equal to or greater than that of belt 10. Further details of the development operation will be described hereinafter with reference to FIG. 4.

With continued reference to FIG. 1, after development, belt 10 advances the toner powder image to transfer station D. At transfer station D, a sheet of support material 48 is moved into contact with the toner powder image. Sheet of support material 48 is advanced to transfer station D by a sheet feeding apparatus (not shown). Preferably, the sheet feeding apparatus includes a feed roll contacting the uppermost sheet of stack of sheets. The feed roll rotates so as to advance the uppermost sheet from the stack into a chute. The chute directs the advancing sheet into contact with the photoconductive surface of belt 10 in a timed sequence so that the toner powder image developed thereon contacts the advancing sheet at transfer station D.

Transfer station D includes a corona generating device which sprays ions onto the back side of sheet 48. This attracts the toner powder image from the photoconductive surface to sheet 48. After transfer, sheet 48 moves in the direction of arrow 52 onto a conveyor (not shown) which advances sheet 48 to fusing station E.

Fusing station E includes a fuser assembly, indicated generally by the reference numeral 54, which permanently affixes the transferred toner powder image to sheet 48. Preferably, fuser assembly 54 includes a heated fuser roller 56 and back-up roller 58. Sheet 48 passes between the fuser roller 56 and back-up roller 58 with the toner powder image contacting fuser roller 56. In this manner, the toner powder image is permanently affixed to sheet 48. After fusing, a chute guides the advancing sheet 48 to a catch tray for subsequent removal from the printing machine by the operator.

Invariably, after the sheet of support material is separated from the photoconductive surface of belt 10, some residual particles remain adhering thereto. These residual particles are cleaned from belt 10 at combined processing station C. In this latter cleaning mode of operation, corona generating device 32, at charging station A, and lamps 38, at exposure station B, are de-energized. Thus, the particles adhering to the photoconductive surface of belt 10 are advanced during this second cycle through processing station C which is now in the cleaning node of operation. In the cleaning mode of operation, light source 60 is energized. Light source 60 is positioned at combined station C so that the light rays therefrom are transmitted through conductive surface 14 onto the back side of photoconductive surface 12. These light rays produce a flow of positive charge through the free surface of the photoconductive surface reducing the adhesion of the particles thereto. In this way, the particles are more readily attracted to the magnetic material adhering to roller 44 of the combined development-cleaning system. It will be appreciated that the illumination generated by light source 60 may be either visible or invisible radiant energy, depending on the radiant energy sensitivity of the photoconductive material. Once again, the tangential velocity of roller 44, in the cleaning zone, is in the same direction as the velocity of belt 10 with magnitude thereof being equal to or greater than that of belt 10. The cleaning process is shown in greater detail in FIG. 5.

During the cleaning cycle, corona generating device 50 of transfer station D is de-energized as is the sheet feeding apparatus.

It is believed that the foregoing description is sufficient for purposes of the present application to illustrate the general operation of the illustrative electrophotographic printing machine incorporating the features of the present invention therein.

Figure 2:
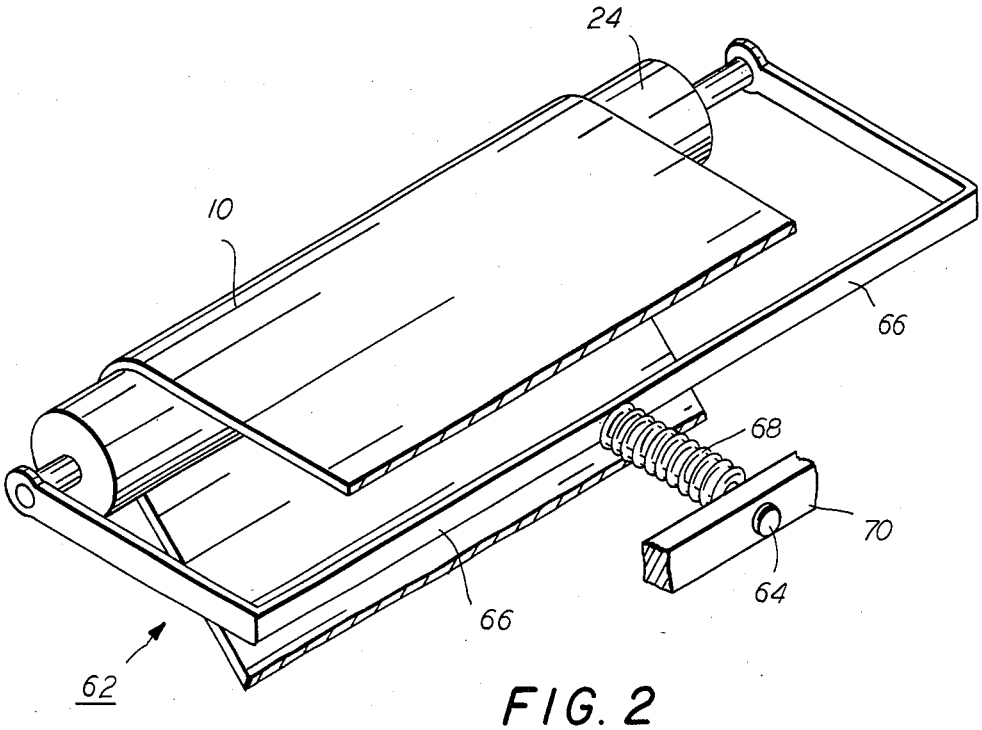
FIG. 2 is a fragmentary, perspective view showing the belt tensioning arrangement for the FIG. 1 printing machine.

Referring now to the specific features of the present invention, FIG. 2 depicts tensioning system 20 in greater detail. As shown thereat, tensioning system 20 includes roller 24 having belt 10 passing thereover. Roller 24 is mounted in suitable bearings in a yoke, indicated generally by the reference numeral 26. Preferably, yoke 26 includes a U-shaped member 62 supporting roller 24 and a rod 64 secured to the mid-point of crossmember 66 of U-shaped member 62. A coil spring 68 is wrapped around rod 64. Rod 64 is mounted slidably in the printing machine frame 70. Coil spring 68 is compressed between crossmember 66 and frame 70. Compressed spring 68 resiliently urges yoke 22 and, in turn, roller 24 against belt 10. By way of example, spring 68 is designed to have the appropriate spring constant such that when placed under the desired compression, belt 10 is tensioned to about 1 pound per inch. Belt 10 is maintained under sufficient tension to enable the toner particles on roller 44 (FIG. 1) to deflect belt 10 through an arc ranging from about 5° to about 25°. Roller 44 has a diameter of about 2.5 inches with the thickness of the layer of toner particles ranging from about 0.005 inches to about 0.050 inches. The desired tension applied to belt 10 is proportional to the diameter of roller 44.

Figure 3:
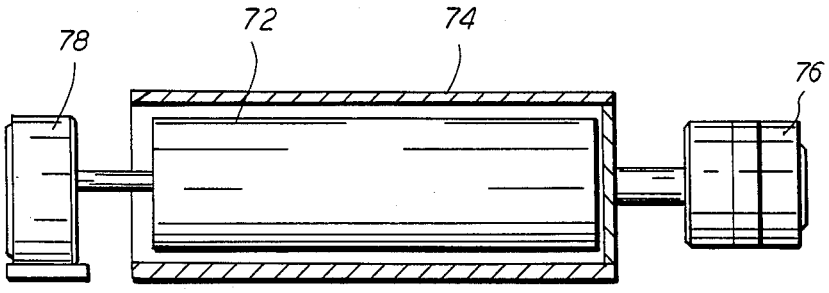
FIG. 3 is a schematic elevational view illustrating the drives used in the processing station of the FIG. 1 printing machine.

Turning now to FIG. 3, there is shown, in greater detail, the combined development-cleaning station and the drives therefore. As illustrated thereat, the combined station includes an elongated magnetic rod 72 disposed interiorly of tubular member 74. Preferably, tubular member 74 is made from a non-magnetic material such as aluminum having the exterior circumferential surface thereof smooth. Magnetic member 72 is positioned concentrically within tubular member 74. Magnetic member 72 is made preferably from barium ferrite. Tubular member 74 is coupled to motor 76. Magnetic member 72 is coupled to indexing motor 78. Indexing motor 78 is periodically actuated so as to orient magnetic member 72 for cleaning and development. In the cleaning mode of operation, a magnetic pole is positioned in the cleaning zone while in the development mode of operation, high speed operation is optimized by positioning a weak magnetic pole in the development zone. Motor 76 rotates tubular member 74 so that the tangential velocity thereof ranges from being equal to to about three times greater than the velocity of belt 10. This further induces agitation and promotes cleaning and development.

Figure 4:
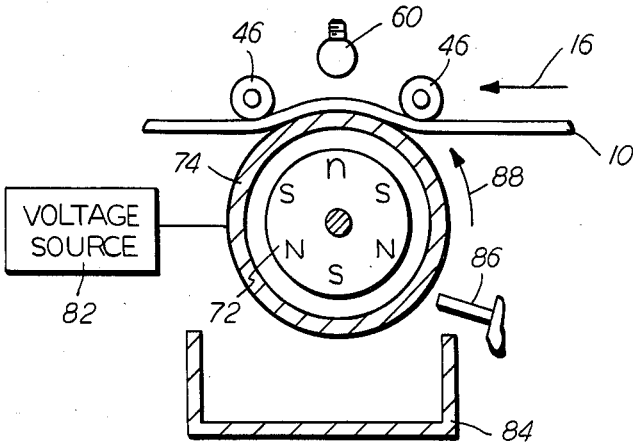
FIG. 4 is a schematic elevational view showing the processing station in the development mode of operation.

Referring now to FIG. 4, there is shown the combined processing station for the development cycle. As depicted thereat, magnet 72 has a plurality of magnetic poles disposed about the circumferential surface thereof. The indexing motor is controlled to rotate magnet 72 so as to position a weak magnetic pole opposed from the photoconductive surface in the region of gap 80. In this way, there is a weak magnetic field in the gap during the development mode of operation. Voltage source 82 is connected to tube 74 and applies an electrical bias thereon. The electrical voltage applied to tube 74 ranges from about 50 volts to about 500 volts. The exact value of the voltage is dependent upon the level of background recorded on the photoconductive surface and the voltage level of the electrostatic latent image. Housing 84 stores a supply of single component magnetic toner particles therein. Preferably, the thickness of the layer of particles adhering to tubular member 74 is maintained between 0.005 inches and 0.050 inches. The thickness of the layer is controlled by metering blade 86. Metering blade 86 is positioned closely adjacent to tube 74 and shears extraneous material therefrom. Under the influence of gravity, the extraneous material deflected or sheared from tube 74 by metering blade 86 falls into the chamber of housing 84. Lamp 60 remains de-energized during the development mode of operation. As shown, tube 74 rotates in the direction of arrow 88. Preferably, tube 74 rotates so that the tangential velocity thereof in the development zone is in the same direction as that of belt 10, i.e. as indicated by arrow 16. However, the magnitude of the tangential velocity ranges from being equal to to about three times greater than that of belt 10. This relative motion helps to loosen the toner particles and enhance toner exchange. The layer of toner particles adhering to tube 74 deflects belt 10 so that belt 10 wraps around tube 74 in an extended arc defining an extended development zone. This development zone preferably is about 12°. This system provides excellent agitation to promote toner particle to toner particle charge exchange due to the relative shear velocities of the photoconductive belt and developer roll. The small gap between the developer roll and the photoconductive surface increases the dynamic conductivity of the particle and increases the fields. Utilization of an extended weak magnetic field for development bounded by strong magnetic fields at the entrance and exit of the development zone enable greater toner particle rotation and mobility enhancing charge convection in the layer of particles developing the latent image. The strong entrance field helps to maintain a stable layer of toner particles between the photoconductive belt and the developer roll. Background development is suppressed by the strong magnetic field in the exit zone. This extended, high conductivity development zone facilitates development to completion and scavenging of particles from the background regions of the photoconductive surface.

Figure 5:
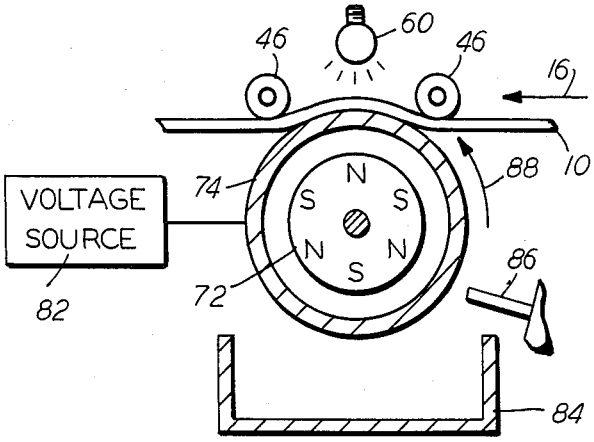
FIG. 5 is a schematic elevational view depicting the processing station in the cleaning mode of operation.

Referring now to FIG. 5, there is shown the combined processing station in the cleaning node of operation. As illustrated thereat, magnetic member 72 is indexed so as to have a magnetic pole opposed from photoconductive surface 12 in the region of gap 80. In this way, a strong magnetic field is formed in gap 80. In operation, voltage source 82 electrically biases tubular member 74 to a voltage level about equal to the background voltage recorded on photoconductive surface 12. Once again, a layer of magnetic single component toner particles is maintained on tubular member 74 and rotates therewith in the direction of arrow 88. Metering blade 86 controls the thickness of the layer of material adhering to tubular member 74. By way of example, the layer of particles ranges from about 0.005 inches to about 0.050 inches. During the cleaning mode of operation, light source 60 is energized. In this way, the attractive force of the photoconductive surface on the residual particles adhering thereto is weakened simultaneously with discharging of the toner particles. Preferably, tubular member 74 rotates at a speed such that the tangential velocity thereof is in the same direction as arrow 16, i.e. the direction of movement of belt 10, and at a speed ranging from being equal to to about three times greater than that of belt 10. Relative motion between tubular member 74 and belt 10 helps to loosen the toner particles. Once again, belt 10 is maintained under a tension such that the material adhering to the exterior circumferential surface of tube 74 is capable of deflecting it. Hence, belt 10 wraps about the circumferential surface of tubular member 74 in an arc of about 20° to define an extended cleaning zone.

Cleaning of single component magnetic toner particles from the photoconductive surface optimally involves neutralizing the charge on the toner particles, erasing the electrostatic latent image, mechanically disturbing the particles and providing maximum magnetic forces to attract the toner particles. Preferably, charge neutralization and image erase should occur simultaneously. In the magnetic brush system of the present invention, excellent particle disturbing action occurs due to the extended, controlled pressure conformable nip and the shearing action between the photoconductive surface and cleaning roller. The significant increase in dynamic conduction through insulating toner particles produces excellent charge neutralization. Exposure of the photoconductive surface during the cleaning action provides for simultaneous image erase and charge neutralization. The optimum thickness of the layer of toner particles provides for maximum magnetic holding forces on the tips of the magnetic brush. The strong magnetic field maximizes the cleaning force. Thus, the magnetic brush system achieves all of the foregoing results during the cleaning operation.

Figure 6:
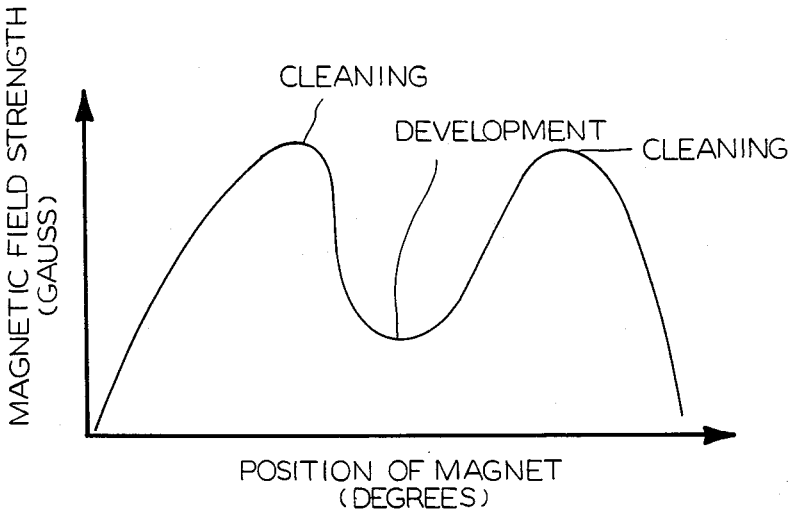
FIG. 6 is a graph depicting the magnetic field strength for the processing station in the FIG. 4 mode of development and the FIG. 5 mode of cleaning.

Referring now to FIG. 6, there is shown a graph of the strength of the magnetic field of magnetic member 72 as a function of the angular rotation thereof relative to gap 80. During development, the magnetic field is weak, as depicted by the weak magnetic field strength. This is achieved by positioning a weak magnet pole opposed from photoconductive surface 12 in the region of gap 80. In the cleaning mode of operation, the magnetic field strength is strong. This is accomplished by indexing magnetic member 72 so as to position a strong magnetic pole opposed from gap 80.

One skilled in the art will appreciate that there are many other ways of regulating the magnetic field in the gap between tubular member 74 and the photoconductive surface. For example, if an electromagnet is employed, the current exciting the electromagnet may be regulated so as to produce a strong magnetic field during cleaning and a weak magnetic field during development. It is apparent that it is not always necessary to rotate the magnet to effectuate control of the strength of the magnetic field in the gap.

Although the exposure station incorporates an optical system for illuminating an original document disposed upon a platen, one skilled in the art will appreciate that a system of this type is not a necessary feature of the present invention. For example, a laser beam may be modulated to selectively discharge the charged portion of the photoconductive belt so as to record the desired information thereon.

In recapitulation, it is clear that the processing station of the present invention develops the electrostatic latent image recorded on the photoconductive surface or cleans extraneous particles adhering thereto. The cleaning and development modes of operation are each optimized by maintaining a thin layer of single component magnetic particle adhering to a transport roller and deflecting the photoconductive belt so as to form an extended cleaning or development zone. Moreover, during the cleaning process, a lamp positioned so that the light rays therefrom are transmitted through the conductive surface onto the back side of the photoconductive surface in the cleaning zone further enhances the cleaning operation. The magnetic field is controlled to be strong in the gap. However, during the development mode of operation, the strength of the magnetic field in the gap is maintained relatively weak with the magnetic fields in the entrance and exit zones being relatively strong. In this manner, the processing station optimizes developing the latent image and cleaning residual particles from the photoconductive surface.

It is, therefore, evident that there has been provided in accordance with the present invention, an apparatus for cleaning a photoconductive surface developing an electrostatic latent image recorded thereon. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A processing station for use in an electrophotographic printing machine for developing an electrostatic latent image recorded on a flexible photoconductive member having at least a photoconductive layer deposited on a substantially transparent conductive layer or cleaning material therefrom, wherein the improvement includes:

means, positioned closely adjacent to the flexible photoconductive member on the side of the photoconductive layer defining a cleaning or developing zone, for transporting magnetically single component magnetic particles into the zone to clean material from the region of the flexible photoconductive member in the zone or to deposit the single component magnetic particles on the region of the flexible photoconductive member in the zone when developing the latent image;

means for maintaining the flexible photoconductive member at a pre-selected tension of sufficient magnitude so that at least the single component magnetic particles on said transporting means deflects the flexible photoconductive member to wrap the flexible photoconductive member about an extended region of the exterior surface of said transporting means to form an extended cleaning or developing zone between said transporting means and the flexible member;

means, positioned on the side of the transparent layer of the flexible photoconductive member, for illuminating the zone during cleaning; and means for controlling said transporting means to position the region of said transporting means having a strong metallic field opposed from the zone during cleaning and the region of the said transporting means having a weak magnetic field opposed from the zone when the latent image is being developed.

2. A processing station according to claim 1, wherein the flexible photoconductive member is a belt.

3. A processing station according to claim 2, wherein said transporting means includes:

a non-magnetic member having a substantially smooth circumferential surface, said tubular member being journaled for rotary movement;

a magnetic member disposed interiorly of said tubular member for attracting the single component magnetic particles to the exterior surface of said tubular member; and means for rotating said tubular member to transport the single component magnetic particles into the cleaning or developing zone.

4. A processing station according to claim 3, further including means for electrically biasing said tubular member.

5. A processing station according to claim 4, wherein said belt wraps about said tubular member in an arc ranging from about 5 degrees to about 25 degrees.

6. A processing station according to claim 5, wherein said maintaining means tensions said belts to a magnitude of about 1 pound per inch.

7. A processing station according to claim 6, wherein the thickness of the layer of single component magnetic particles attracted to said tubular member ranges from about 0.005 inches to about 0.050 inches.

* * * * *